US006501433B2

(12) United States Patent
Popa et al.

(10) Patent No.: US 6,501,433 B2
(45) **Date of Patent: *Dec. 31, 2002**

(54) COAXIAL DIELECTRIC ROD ANTENNA WITH MULTI-FREQUENCY COLLINEAR APERTURES

(75) Inventors: Adrian E. Popa, Thousand Oaks, CA (US); William B. Bridges, Pasadena, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/879,865

(22) Filed: Jun. 12, 2001

(65) Prior Publication Data

US 2002/0030632 A1 Mar. 14, 2002

Related U.S. Application Data

(63) Continuation-in-part of application No. 09/482,166, filed on Jan. 12, 2000, now Pat. No. 6,266,025.

(51) Int. Cl.[7] ..... H01Q 13/00
(52) U.S. Cl. ..... 343/785; 333/21 R
(58) Field of Search ..... 343/719, 785, 343/786, 854, 872, 873; 333/21 R

(56) References Cited

U.S. PATENT DOCUMENTS

| | | | | |
|---|---|---|---|---|
| 4,274,097 A | | 6/1981 | Krall et al. | 343/719 |
| 4,293,833 A | | 10/1981 | Popa | 333/239 |
| 4,785,306 A | | 11/1988 | Adams | 343/786 |
| 4,800,350 A | | 1/1989 | Bridges et al. | 333/239 |
| 5,166,698 A | | 11/1992 | Ashbaugh et al. | 343/783 |
| 5,684,495 A | | 11/1997 | Dyott et al. | 343/785 |
| 5,936,589 A | | 8/1999 | Kawahata | 343/785 |
| 6,266,025 B1 | * | 7/2001 | Popa et al. | 333/21 R |

FOREIGN PATENT DOCUMENTS

| | | |
|---|---|---|
| EP | 0 443 526 A1 | 8/1991 |
| JP | 10256822 | 9/1998 |
| WO | 01/52354 | 7/2001 |

OTHER PUBLICATIONS

Bruno, W.M., et al., "Flexible Dielectric Waveguides with Powder Cores," *IEEE Transactions on Microwave Theory and Techniques*, vol. 36, No. 5 (May 1988), pp. 882–890.
Mueller, G.E., et al., "Polyrod Antennas," Bell System Technical Journal, vol. XXVI (Oct. 1947(, pp. 837–851.
Kraus, J.D., *Antennas*, Second Edition, McGraw–Hill, Inc., pp. 685–687.

* cited by examiner

*Primary Examiner*—Don Wong
*Assistant Examiner*—Shih-Chao Chen
(74) *Attorney, Agent, or Firm*—Ladas & Parry

(57) ABSTRACT

An antenna. The antenna includes a first dielectric antenna rod having a first dielectric constant. The first dielectric antenna rod is coupled to a first frequency transmission source for propagating first frequency band radiation from the first dielectric antenna rod into a medium having a medium dielectric constant. A second dielectric antenna rod is provided having a second dielectric constant. The second dielectric antenna rod is coupled to a second frequency transmission source for propagating second frequency band radiation from the second dielectric antenna rod into the medium. The first dielectric antenna rod is coaxially mounted within the second dielectric antenna rod. The first dielectric constant is greater than the second dielectric constant. The second dielectric constant is greater than the medium dielectric constant.

50 Claims, 6 Drawing Sheets

COAXIAL DIELECTRIC ROD ANTENNA WITH MULTI-FREQUENCY COLLINEAR APERTURES

CROSS-REFERENCE TO RELATED APPLICATIONS

This application is a continuation-in-part application of U.S. patent application Ser. No. 09/482,166 entitled "Coaxial Dielectric Rod Antenna with Multi-Frequency Collinear Apertures", filed Jan. 12, 2000, now U.S. Pat. No. 6,266,025, the entire specification of which is expressly incorporated herein by reference.

FIELD OF THE INVENTION

This invention relates to the field of antennas, and more particularly, to antenna structures for covering a diversity of frequency bands.

BACKGROUND

A large number of different radio frequency systems have come into use for communication, navigation, electronic warfare and radar systems. State-of-the-art automotive and aerospace-borne vehicles which utilize such radio frequency systems could have more than a dozen separate antennas to cover a diversity of frequency bands. However, many mobile platforms have limited space for multiple antennas operating in widely separated frequency bands.

Alternatively, a number of wide bandwidth antenna elements have been developed for electronic warfare and signal intelligence systems. Current state-of-the-art antennas include flared notch elements, each with about an octave of bandwidth (2:1). Other antenna elements such as spirals, log periodic elements, biconical dipoles and conical monopoles all have a bandwidth limit of about 2:1 and they tend to have relatively large physical dimensions and, as such, are not well-suited for mobile platform vehicular use.

One solution to this multi-antenna, multi-aperture problem now faced by land, sea, air and space-borne vehicles has been multi-function, multi-frequency, phased array antenna apertures with electronic beam forming and scanning/tracking. However, today broadband antenna elements and phased array antennas are limited by the bandwidth and dimensions of the antenna-feed elements to a maximum frequency ratio of about one octave (2:1). Broad bandwidth phased array antennas composed of broadband feed elements must address several conflicting design parameters:

1) low side lobes require that the phase centers of the feed antennas be closely spaced one half wavelength apart at the highest frequency of operation;
2) feed antennas have dimensions approaching one half wavelength at the lowest operating frequency;
3) large numbers of broadband amplifiers must be connected to every feed antenna in a 2:1 bandwidth array; and
4) a second set of crossed linear antenna elements and associated electronics often are required if the array is to transmit and receive signals in orthogonal linear polarization and in both circular polarizations.

Therefore, there exists a need for an effective antenna structure which can cover a diversity of frequency bands, a diversity of polarizations, and can be useful in phased array antenna systems. The present invention provides a unique solution to meet such needs.

SUMMARY OF THE INVENTION

In accordance with the present invention, an inventive three dimensional, ultra-broad bandwidth, multi-aperture, dielectric antenna is provided which combines features of tapered dielectric rod antennas and coaxial dielectric waveguide transmission lines. The coaxial dielectric rod antenna (CDRA) in accordance with the present invention has multi-frequency collinear apertures which can be optimized for use as individual multi-band antennas or as feed elements in broad bandwidth active aperture phased array antennas. In essence, the CDRA in accordance with the present invention combines into a single structure many separate antennas which cover a diversity of frequency bands.

A first embodiment of the invention includes a first dielectric antenna rod having a first dielectric constant. The first dielectric antenna rod is coupled to a first frequency transmission source for propagating first frequency band radiation from the first dielectric antenna rod into a medium having a medium dielectric constant. A second dielectric antenna rod is provided having a second dielectric constant. The second dielectric antenna rod is coupled to a second frequency transmission source for propagating second frequency band radiation from the second dielectric antenna rod into the medium. The first dielectric antenna rod is coaxially mounted within the second dielectric antenna rod. The first dielectric constant is greater than the second dielectric constant. The second dielectric constant is greater than the medium dielectric constant.

In accordance with the first embodiment, the second dielectric antenna rod can include an axial cylindrical cavity along the length of the second dielectric antenna rod. The axial cylindrical cavity can be filled with a dielectric powder having the first dielectric constant. The dielectric powder can be secured within the axial cylindrical cavity by end plugs having the first dielectric constant and be located at respective proximal and distal ends of the second dielectric antenna rod. Further, the first frequency transmission source can be axially coupled to the first dielectric antenna rod while the second frequency transmission source can be coupled to the second dielectric antenna by a transmission line axially offset from the second dielectric antenna rod. The second dielectric antenna rod can be made of a thermoplastic resin. The dielectric powder can be barium tetratitanate or nickel-aluminum titanate.

Another embodiment of the present invention includes a first dielectric antenna rod having a first dielectric constant. The first dielectric antenna rod is coupled to a first frequency transmission source for propagating first frequency band radiation from the first dielectric antenna rod into a medium having a medium dielectric constant. A second dielectric antenna rod is provided having a second dielectric constant. The second dielectric antenna rod is coupled to a second frequency transmission source for propagating second frequency band radiation from the second dielectric antenna rod into the medium. The first dielectric antenna rod is coaxially mounted within the second dielectric antenna rod. A third dielectric antenna rod having a third dielectric constant is also provided. The third dielectric antenna rod is coupled to a third frequency transmission source for propagating third frequency band radiation from the third dielectric antenna rod into the medium. The second dielectric antenna rod is coaxially mounted within the third dielectric antenna rod. The first dielectric constant is greater than the second dielectric constant. The second dielectric constant is greater than the third dielectric constant. The third dielectric constant is greater than the medium dielectric constant.

DETAILED DESCRIPTION

A uniform rod of dielectric material is a well-known type transmission line for electromagnetic waves ranging in wavelength from radio to optical frequencies. Various microwave and milli-meter wave dielectric transmission lines have been demonstrated, including single dielectric fibers, as described in U.S. Pat. No. 4, 293,833 issued to Popa, and coaxial fibers of multiple dielectrics as described in U.S. Pat. No. 4,800,350 issued to Bridges et al. A microwave transition using dielectric waveguide is described in U.S. Pat. No. 5,684,495 issued to Dyott et al. in which a dielectric rod antenna couples a standard metallic waveguide to a dielectric rod transmission line.

Similarly, narrowband polyrod dielectric antennas and antenna arrays are well-known. Such antennas include those developed at the Bell Telephone Laboratories during World War II for radar antenna array elements, as described in the Bell System Technical Journal, Vol. XXVI, 1947, pages 837–851. Also, an embedded dielectric rod antenna has been described in U.S. Pat. No. 4,274,097 issued to Krall et al. that embeds a dielectric rod antenna with a relative dielectric constant of 84 in a dielectric cylinder of relative dielectric constant 81. High dielectric constant material is used to form a compact narrow beam antenna.

Further, dual frequency antennas have been developed involving a dielectric transmission line. A dual frequency feed satellite antenna horn is described in U.S. Pat. No. 4,785,306 issued to Adams in which a Ku band dielectric transmission line passes along the center of a conventional metallic C-band waveguide and then exits through an end wall.

In dielectric transmission lines of this type, a portion of the energy travels along the inside of the dielectric rod and a portion travels along in the space outside of the rod. Electromagnetic energy can propagate along the dielectric fiber in a series of modes with the lowest order HE11 mode being the mode of primary interest. The useful bandwidth of the dielectric waveguide extends from the lowest frequency at which the HE11 mode is reasonably well contained up to the lowest frequency where the next lowest order modes, the TM01 and TE01, can propagate.

Figure 1:
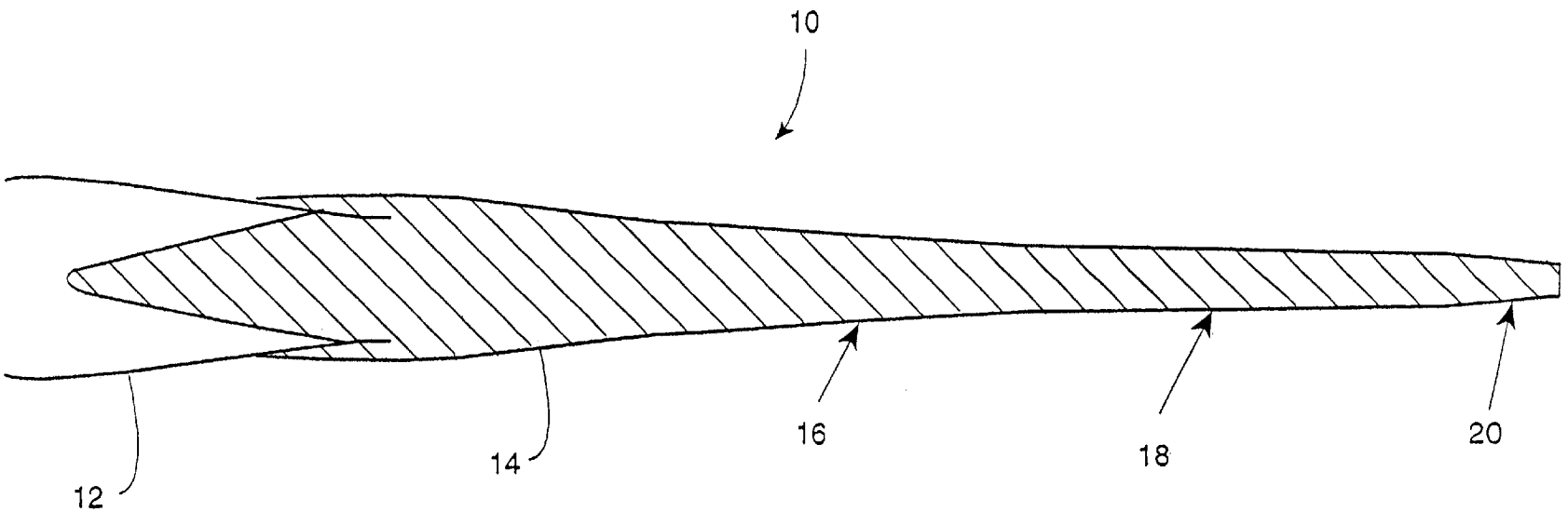
FIG. 1 (PRIOR ART)
FIG. 1 shows in schematic form a prior art polyrod tapered dielectric antenna.

When internal or external discontinuities are encountered along the dielectric rod, radiation takes place. This tendency was used to advantage at the Bell Telephone Laboratories in the 1940s to form the microwave "polyrod" antennas. A representative polyrod tapered dielectric antenna 10 is schematically depicted in FIG. 1 and is discussed in more detail in Chapter 16 of the Antenna Engineering Handbook, published by McGraw-Hill, 1961. Dielectric antenna 10 is coupled to metal waveguide 12 and typically has a feed taper 14, a body taper 16, a straight section 18 and a terminal taper section 20. In the dielectric rod antenna, radiation is encouraged from all parts of the rod by gradually tapering the diameter of the rod and then abruptly terminating it at a point where the radiation has been essentially completed. By well-known proper design techniques, this radiating structure forms a directional endfire antenna with the gain determined, primarily by the length of the taper.

The dielectric rod transmission line can be turned into a coaxial dielectric transmission line by surrounding the core rod with a second dielectric cylinder of lower dielectric constant. This outer sheath confines the electric fields less tightly than does air with its relative dielectric constant $\in$ of 1; however, by making the difference, between the dielectric constant of the core rod and the dielectric constant of the sheath, greater than about 10, the majority of the energy is confined within the core rod, protecting these fields from outside influence. This efficiently propagates the microwave energy through the rods in a manner similar, but not identical, to the concept used in optical fiber transmission lines.

In accordance with the present invention, features of the dielectric rod antenna and coaxial dielectric transmission lines are combined to form a series of concentric collinear apertures, each operating in the fundamental HE11 mode over greater than 2:1 frequency ratios in their respective frequency bands.

Figure 2:
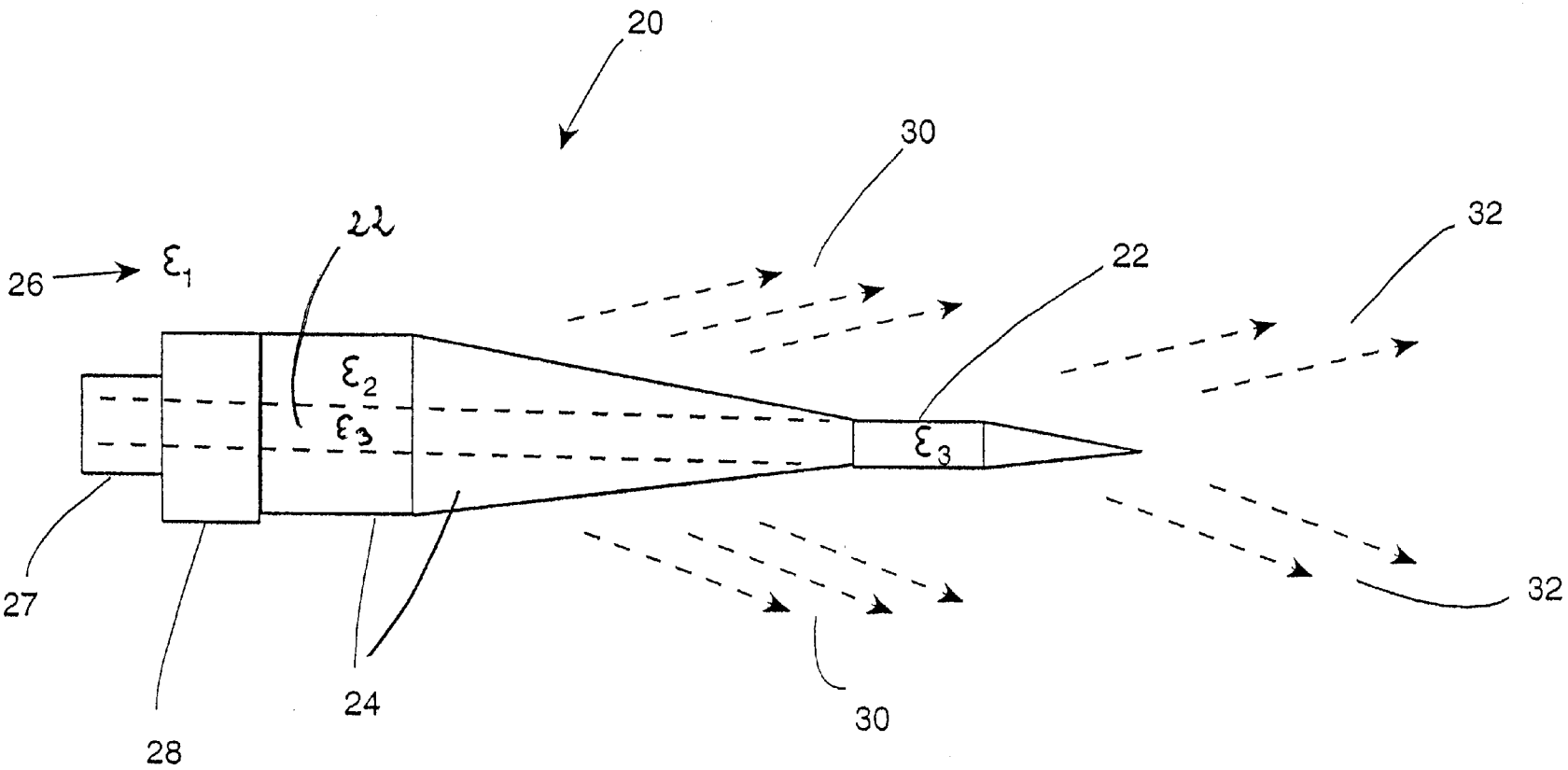
FIG. 2 shows in schematic form an embodiment of the present invention.
Figure 3:
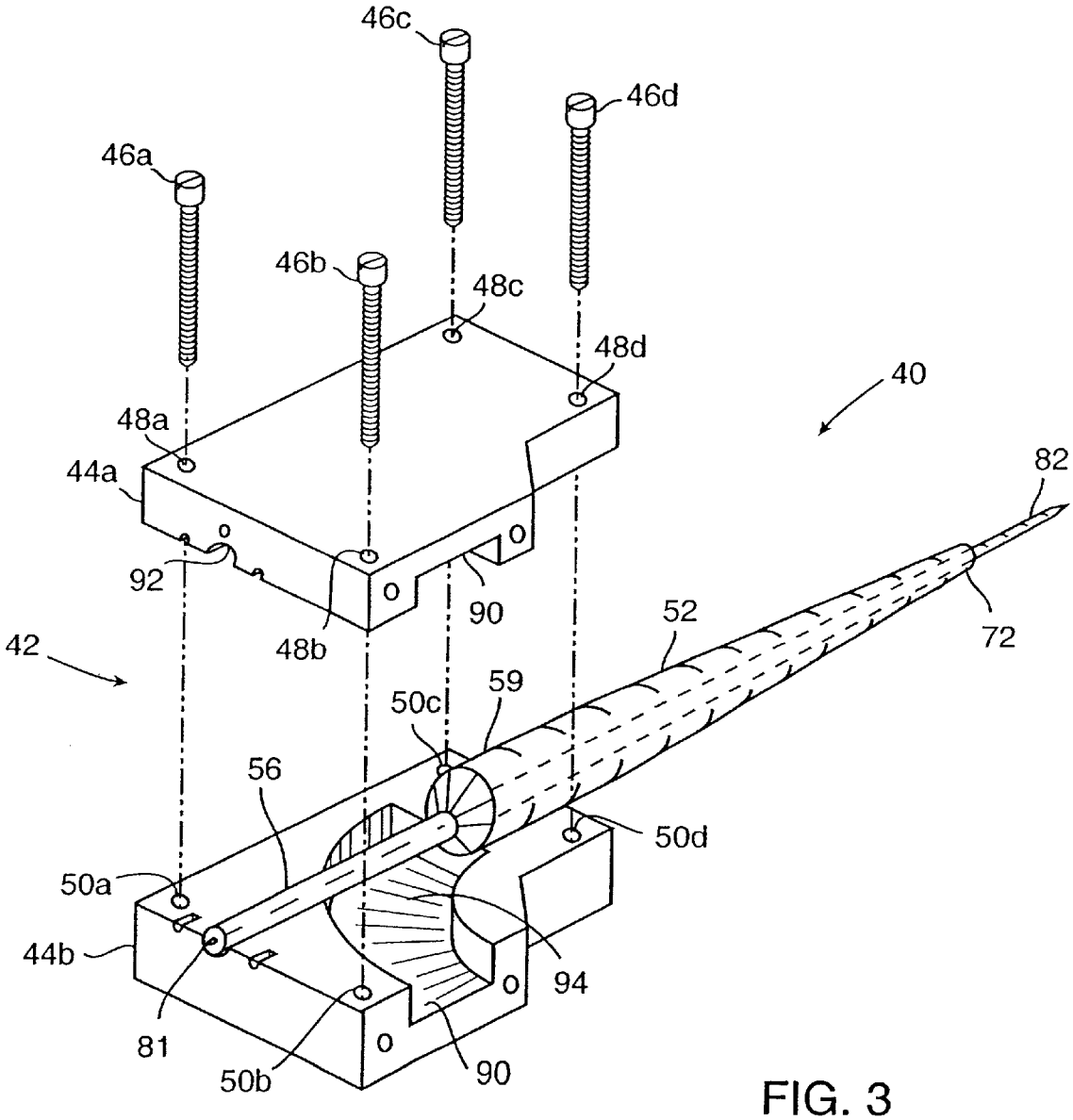
FIG. 3 shows a partially exploded perspective view of an embodiment of the present invention.
Figure 4A:
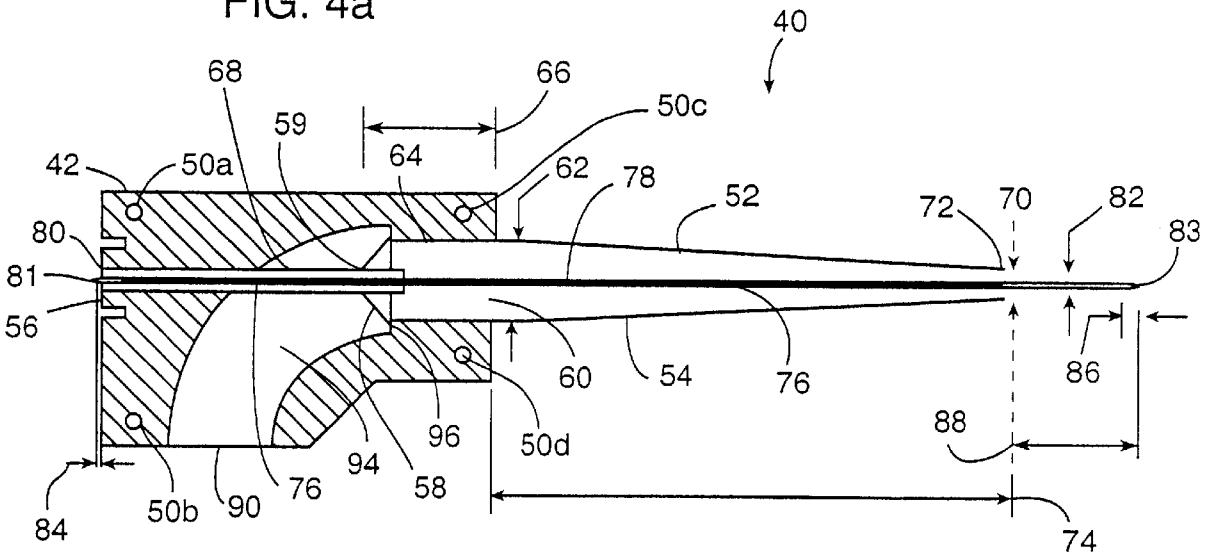
FIGS. 4*a*–4*c* show plan and section views of an embodiment of the present invention.
Figure 4B:
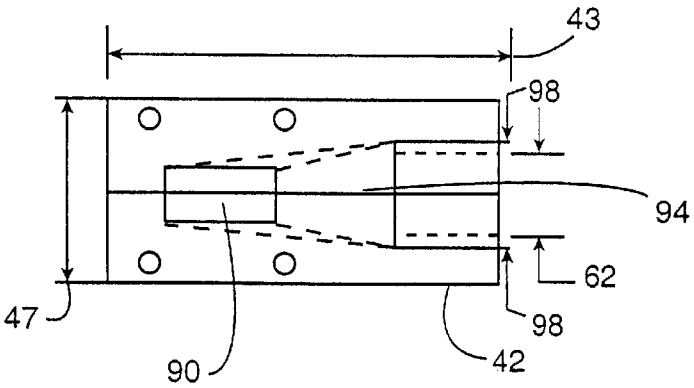
Figure 4C:
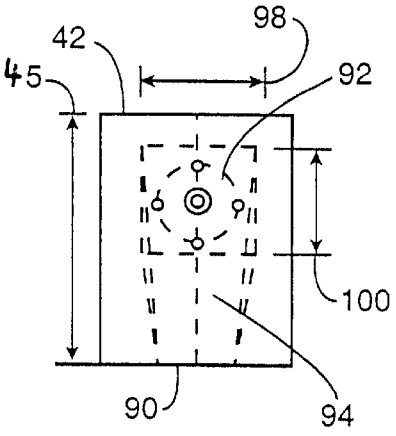

Referring to FIG. 2, the present invention is depicted in simplified schematic form. Antenna 20, which in the embodiment described below is configured for operation both at 9.4 GHz in "low" frequency X-band and at 94 GHz in "high" frequency W-Band, includes a core rod 22 of dielectric constant F which is inserted into an outer rod 24 which has a dielectric constant $\in_2$. The antenna 20 is is surrounded by medium 26 of dielectric constant $\in_1$ (usually air), forming two concentric dielectric transmission lines, which are respectively coupled to a high band waveguide transducer 27 and a low band waveguide transducer 28. Dielectric constant $\in_3$ is preferably greater than dielectric constant $\in_2$ which is preferably greater than dielectric constant $\in_1$. By tapering the combined structure of antenna 20 in a controlled manner, the transmission line formed by dielectric rod 24 (dielectric constant $\in_2$) will provide for radiating low band radiation 30 along the tapered surface of rod 24 into the medium 26 (dielectric constant $\in_1$). The second collinear transmission line is formed by embedding dielectric rod 22 (dielectric constant $\in_3$) within dielectric rod 24 (dielectric constant $\in_2$) and will provide for radiating high band radiation 32 when rod 22 is exposed to the medium 26 and is tapered into the medium 26 as depicted by FIG. 2. The dielectric constant $\in_2$ of the outer rod 24 is preferably in the range of about 1.5 to about 10, and more preferably about 2.08, as 13 provided by Teflon™ material. To confine the majority of the energy in the core rod 22, the dielectric constant $\in_3$ of the core rod 22 is preferably in the range of about 10 to about 30, more preferably around 30 as provided by barium tetra-titanate.

The bandwidth and gain of each of these apertures can be individually adjusted for a specific application or they can be optimized for combined operation as feed antennas as part of a large active aperture phased array antenna system.

Referring collectively to FIGS. 3 and 4*a*–4*c*, there is depicted a first embodiment of the present invention. Antenna 40 includes support housing 42, which is made from two symmetrical mirror image aluminum housing blocks 44*a*, 44*b*, each having length 43 of 3.5', width 45 of 2.25' and combined height 47 of 1.625'. Block 44*a* clamps down on block 44*b* and is secured in place by screws 46*a*–46*d* passing through clearance holes 48*a*–48*d* coupling with threaded holes 50*a*–50*d*. Support rod 52 includes tapered rod 54, thin tubing 56 and tapered transition 58. Tapered transition 58 at proximal end 59 of tapered rod 54 has a 45° taper thereat and couples tapered rod 54 with thin tubing 56. Support rod 52 is made of a relatively loss-less dielectric material having a dielectric constant greater than that of air, e.g., having an $\in_2$=2.08, such as that provided by thermoplastic resins and, in particular, the commonly known fluorocarbon resin Teflon (trademark). Thin tubing 56 can be formed from standard AWG20 teflon tubing. Tapered rod 54 has a straight section 60 having a diameter 62 of approximately 0.75' for tapered rod 54 support in cylindrical recess 64 of housing blocks 44*a,* 44*b,* and having a support length 66 of 1'. Thin tubing 56 is likewise supported in cylindrical recess 68 of housing blocks 44*a,* 44*b,* cylindrical recess 68 being dimensioned to allow a press-fit of AWG20 size tubing. Cylindrical recess 68 is in axial alignment with cylindrical recess 64. Tapered rod 54 tapers from dimension 62 at the edge of housing blocks 44*a,* 44*b* to dimension 70 of 2 mm at tapered rod distal end 72 over taper length 74 of 4.75'.

Support rod 52 axially houses therein an axial cylindrical cavity 76 of approximately 1 mm diameter. Cylindrical cavity 76 is filled with powder-like high dielectric material 78 and has proximal end cap 80 and distal end cap 82 terminating each end. Proximal end cap 80 and distal end cap 82 are typically rigid pieces of approximately 1 mm diameter press-fit supported over a suitable length of cylindrical cavity 76, typically made of the same material as powder-like material 78, and act as plugs. Proximal end cap,80 has a taper 81 over length 84 of 2 mm and protrudes the same amount from housing blocks 44*a,* 44*b.* Distal end cap 82 has a similar taper 83 over length 86 of 2 mm. Distal end cap 82 extends distance 88 of approximately 1.125' from tapered rod distal end 72.

In the first embodiment, material with a dielectric constant of 30, such as barium tetra-titanate powder or nickel-aluminum titanate powder, as is described in U.S. Pat. No. 4,800,350 entitled "Dielectric Waveguide Using Powdered Material", was found to be a most effective powder-like material 78. Those skilled in the art will recognize that the material and the powder consistency can be varied to enable changeable antenna frequencies.

As referred to above, the low frequency antenna of the present embodiment is designed to operate at 9.4 GHz while the high frequency antenna operates at 94 GHz. There are, accordingly, two corresponding waveguide ports for the respective frequency inputs, namely, low frequency port 90 and high frequency port 92. Low frequency port 90 is a standard WR90 waveguide port, having a 0.9' by 0.4' waveguide mouth. High frequency port 92 is a standard WR8 waveguide port having a 0.08' by 0.04' waveguide mouth. Standard mounting holes are provided to enable corresponding WR90 and WR8 feed transmission lines (not shown) to be coupled to support housing 42. In the first embodiment, low frequency port 90 is physically located at 90° to high frequency port 92. High frequency port 92 is axially in line with the dielectric rods of the antenna. Low frequency port 90 tapers over 90° bend 94 to interface with end 96 of housing cylindrical recess 64. As such, low frequency port 90 tapers to end 96 having guide dimensions 98, 100 of 0.9' by 0.9' respectively.

Support rod 52 can be press fit into housing cylindrical recess 64. However, support rod 52 can be allowed to be axially-moveable to allow frequency tuning of the antenna if desired.

Figure 5:
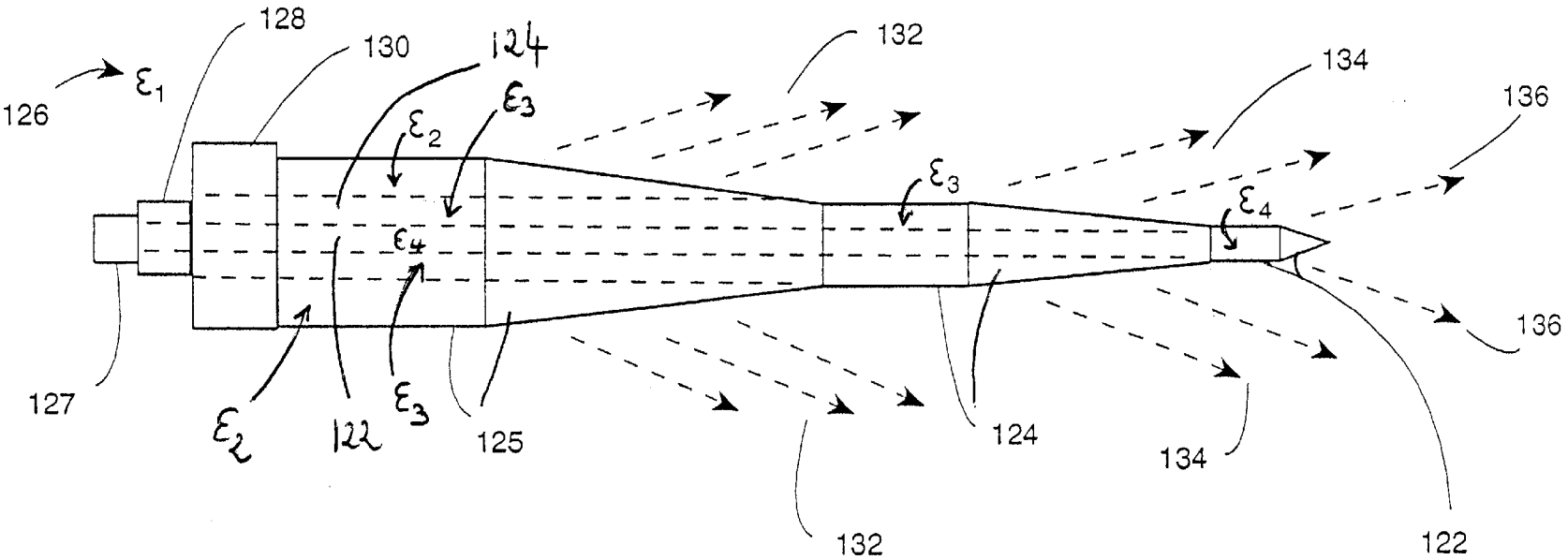
FIG. 5 shows in schematic form another embodiment of the present invention.

Those skilled in the art will appreciate that it is possible to extend this invention to operation in three frequency bands by triaxially embedding dielectric rods of increasingly greater dielectric constants. This is schematically depicted in FIG. 5. Core rod 122 of dielectric constant $\in_4$ is inserted into rod 124 of dielectric constant $\in_3$, which in turn is inserted into rod 125 of dielectric constant $\in_2$. The non-imbedded portions of the respective rods are surrounded by medium 126 of dielectric constant $\in_1$ (usually air), forming three concentric dielectric transmission lines, which are respectively coupled to high band waveguide transducer 127, mid-band waveguide transducer 128 and low band waveguide transducer 130. To confine the majority of the high band energy in the core 122 until the core 122 is exposed to the medium 126 (dielectric constant $\in_1$) and radiates energy 136, the dielectric constant $\in_4$ is preferably greater than about 10 and also preferably greater than the dielectric constant $\in_3$ of rod 124. The value of $\in_4$ preferably ranges from about 20 to about 30, and is more preferably about 30, the value of barium tetra-titanate. To confine the majority of the mid band energy in the rod 124 until the rod 124 is exposed to the medium 126 (dielectric constant $\in_1$) and radiates energy 134, the dielectric constant $\in_3$ is preferably greater than about 10 and also preferably greater than the dielectric constant $\in_2$ of rod 125. The value of $\in_3$ preferably ranges from about 10 to about 20, and is more preferably about 12. Exemplary adequate materials for rod 124 include silicon ($\in$=11.8) and gallium arsenide ($\in$=13.2). The dielectric constant $\in_2$ of the first rod 125 radiating low band energy 132 when tapered into the medium 126 (dielectric constant $\in_1$) is preferably in the range of about 1.5 to about 10, more preferably about 2.08, as provided by Teflon™ material.

Those skilled in the art can also appreciate that it is possible to extend this invention to operation in four, five, six or any number of frequency bands by increasing the multiple embedding dielectric rods of increasingly greater dielectric constants.

Figure 6C:
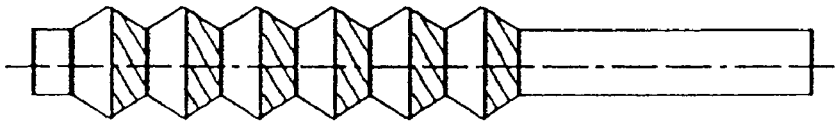
FIGS. 6*a*–6*c* show alternative embodiments of the present invention.
Figure 6B:
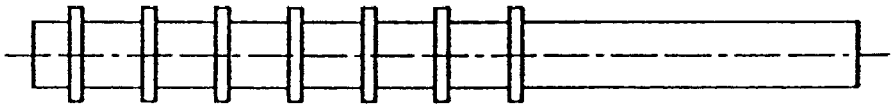
Figure 6A:
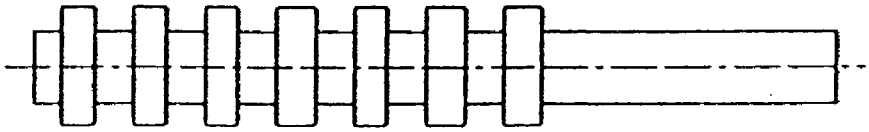

Further, dielectric rod antennas with periodic perturbations excited by dielectric rod transmission lines have been developed for use over smaller bandwidths (a few percent) to shape the radiation patterns for omndirectional coverage and are described in the literature. These configurations, examples of which are depicted in FIGS. 6*a,* 6*b,* and 6*c,* could also be incorporated by those skilled in the art.

As has been described hereinabove, a coaxial dielectric rod antenna (CDRA) has been provided with multi-frequency collinear apertures that combines thin (relative to a half wavelength in air) dielectric rod antenna elements embedded with a series of one or more coaxial dielectric waveguides with collinear tapered radiating apertures of increasing dielectric constant, forming an array of two or more radiating apertures. Each of the radiating apertures on the CDRA can operate over a broad bandwidth in different frequency bands. All of the elements in the CDRA support both linear and circular polarizations and each of the collinear apertures can be coupled to separate electronics modules, each of which are optimized for use in the specific frequency band of operation.

When combined into a phased array antenna, the CDRA antenna elements can provide several novel features:

1) Each radiating aperture on the coaxial rod has an operating bandwidth ratio of at least 2:1. Thus, a two-aperture antenna would provide an operating bandwidth of 4:1 and a three-aperture antenna would operate over an 8:1 frequency range.
2) A multi-aperture CDRA could operate in widely separated frequency bands such as X-Band and W-Band.

3) The diameter of the CDRA dielectric waveguides can be very small at the lowest operating frequencies, enabling dense spacing to support operation at the highest operating frequencies.

4) The CDRA feed elements reduce the number and complexity of the electronics in the feed manifold by enabling separate, optimized electronics transmitter/receiver (T/R) circuits to be packaged in separate planes located behind the antenna surface.

5) The endfire nature of the CDRA eliminates the need for a metallic ground plane at the base of the feed antennas, which is required for most currently used broadband antenna feed elements. This will reduce the weight of phased array antennas and enable mounting antennas of this type on plastic and composite surfaces now in common use in aircraft, spacecraft and automotive structures.

What is claimed is:

1. A method of structuring an antenna, comprising the steps of:

providing a first dielectric antenna rod having a first dielectric constant, the first dielectric antenna rod being coupled to a first frequency transmission source for propagating first frequency band radiation from the first dielectric antenna rod into a medium having a medium dielectric constant; and coaxially mounting the first dielectric antenna rod within a second dielectric antenna rod having a second dielectric constant, the second dielectric antenna rod being coupled to a second frequency transmission source for propagating second frequency band radiation from the second dielectric antenna rod into the medium;

wherein the first dielectric constant is greater than the second dielectric constant and the second dielectric constant is greater than the medium dielectric constant, and wherein the difference between the first dielectric constant and the second dielectric constant is greater than about 10.

2. The method of structuring an antenna of claim 1, wherein the first dielectric constant is within a range of about 10 to about 30.

3. The method of structuring an antenna of claim 2, wherein the first dielectric constant is about 30.

4. The method of structuring an antenna of claim 2, wherein the first dielectric antenna rod is essentially made of barium tetra-titanate.

5. The method of structuring an antenna of claim 1, wherein the second dielectric constant is within a range of about 1.5 to about 10.

6. The method of structuring an antenna of claim 5, wherein the second dielectric constant is about 2.08.

7. The method of structuring an antenna of claim 5, wherein the second dielectric antenna rod is essentially made of teflon™ material.

8. The method of structuring an antenna of claim 1, wherein the first dielectric antenna rod is formed by:

forming an axial cylindrical cavity along the length of the second dielectric antenna rod;

filling the axial cylindrical cavity with a dielectric powder having the first dielectric constant; and securing the dielectric powder within the axial cylindrical cavity with end plugs having the first dielectric constant located at respective proximal and distal ends of the second dielectric antenna rod.

9. The method of structuring an antenna of claim 8, wherein the second dielectric antenna rod is essentially made of a thermoplastic resin and the dielectric powder is barium tetra-titanate or nickel-aluminum titanate.

10. The method of structuring an antenna of claim 9, wherein the thermoplastic resin is fluorocarbon resin teflon™ material.

11. The method of structuring an antenna of claim 1, wherein the first dielectric antenna rod is formed by:

forming an axial cylindrical cavity along the length of the second dielectric antenna rod;

filling the axial cylindrical cavity with a dielectric rod having the first dielectric constant; and securing the dielectric rod within the axial cylindrical cavity with end plugs having the first dielectric constant located at respective proximal and distal ends of the second dielectric antenna rod.

12. The method of structuring an antenna of claim 11, wherein the second dielectric antenna rod is essentially made of a thermoplastic resin and the dielectric rod is essentially made of barium tetra-titanate or nickel-aluminum titanate.

13. The method of structuring an antenna of claim 12, wherein the thermoplastic resin is fluorocarbon resin teflon™ material.

14. The method of structuring an antenna of claim 1, wherein:

the first frequency transmission source is axially coupled to the first dielectric antenna rod; and the second frequency transmission source is coupled to the second dielectric antenna by a transmission line axially offset from the second dielectric antenna rod.

15. The method of structuring an antenna of claim 1, wherein each of the first dielectric antenna rod and the second dielectric antenna rod has an operating beamwidth ratio of at least 2:1, and thus the antenna has an operating beamwidth ratio of at least 4:1.

16. The method of structuring an antenna of claim 1, wherein the first dielectric antenna rod operates in X-Band and the second dielectric antenna rod operates in W-Band.

17. The method of structuring an antenna of claim 16, wherein the first dielectric antenna rod operates at about 9.4 GHz and the second dielectric antenna rod operates at about 94 GHz.

18. The method of structuring an antenna of claim 1, wherein a portion of the first dielectric antenna rod is tapered, and wherein a portion of the second dielectric antenna rod is tapered.

19. A method of structuring an antenna, comprising the steps of:

providing a first dielectric antenna rod having a first dielectric constant, the first dielectric antenna rod being coupled to a first frequency transmission source for propagating first frequency band radiation from the first dielectric antenna rod into a medium having a medium dielectric constant;

coaxially mounting the first dielectric antenna rod within a second dielectric antenna rod having a second dielectric constant, the second dielectric antenna rod being coupled to a second frequency transmission source for propagating second frequency band radiation from the second dielectric antenna rod into the medium; and coaxially mounting the second dielectric antenna rod within a third dielectric antenna rod having a third dielectric constant, the third dielectric antenna rod being coupled to a third frequency transmission source for propagating third frequency band radiation from the third dielectric antenna rod into the medium;

wherein the first dielectric constant is greater than the second dielectric constant, the second dielectric constant is greater than the third dielectric constant, and the third dielectric constant is greater than the medium dielectric is constant, and wherein the difference between the first dielectric constant and the third dielectric constant is greater than about 10.

20. The method of structuring an antenna of claim 19, wherein the first dielectric constant is greater than about 10.

21. The method of structuring an antenna of claim 20, wherein the first dielectric constant is within a range of about 20 to about 30.

22. The method of structuring an antenna of claim 21, wherein the first dielectric constant is about 30.

23. The method of structuring an antenna of claim 21, wherein the first dielectric antenna rod is essentially made of barium tetra-titanate.

24. The method of structuring an antenna of claim 19, wherein the second dielectric constant is greater than about 10.

25. The method of structuring an antenna of claim 24, wherein the second dielectric constant is within a range of about 10 to about 20.

26. The method of structuring an antenna of claim 25, wherein the second dielectric constant is about 12.

27. The method of structuring an antenna of claim 25, wherein the second dielectric antenna rod is made of silicon and has a second dielectric constant of about 11.8.

28. The method of structuring an antenna of claim 25, wherein the second dielectric antenna rod is made of gallium arsenide and has a second dielectric constant of about 13.2.

29. The method of structuring an antenna of claim 19, wherein the third dielectric constant is within a range of about 1.5 to about 10.

30. The method of structuring an antenna of claim 29, wherein the third dielectric antenna rod is essentially made of teflon™ material and the third dielectric constant is about 2.08.

31. The method of structuring an antenna of claim 19, wherein each of the first dielectric antenna rod, the second dielectric antenna rod and the third dielectric antenna rod has an operating beamwidth ratio of at least 2:1, and thus the antenna has an operating beamwidth ratio of at least 8:1.

32. An antenna comprising:

a first dielectric antenna rod having a first dielectric constant, the first dielectric antenna rod being coupled to a first frequency transmission source for propagating first frequency band radiation from the first dielectric antenna rod into a medium having a medium dielectric constant; and a second dielectric antenna rod having a second dielectric constant, the second dielectric antenna rod being coupled to a second frequency transmission source for propagating second frequency band radiation from the second dielectric antenna rod into the medium, the first dielectric antenna rod being coaxially mounted within the second dielectric antenna rod;

wherein the first dielectric constant is greater than the second dielectric constant and the second dielectric constant is greater than the medium dielectric constant, and wherein the difference between the first dielectric constant and the second dielectric constant is greater than about 10.

33. The antenna of claim 32, wherein the first dielectric constant is within a range of about 10 to about 30.

34. The antenna of claim 33, wherein the first dielectric antenna rod is made of barium tetra-titanate and the first dielectric constant is about 30.

35. The antenna of claim 32, wherein the second dielectric constant is within a range of about 1.5 to about 10.

36. The antenna of claim 35, wherein the second dielectric antenna rod is made of Teflon™ material and the second dielectric constant is about 2.08.

37. The antenna of claim 32, wherein the second dielectric antenna rod includes an axial cylindrical cavity along the length of the second dielectric antenna rod, the axial cylindrical cavity being filled with a dielectric powder having the first dielectric constant, and the dielectric powder being secured within the axial cylindrical cavity by end plugs having the first dielectric constant and being located at respective proximal and distal ends of the second dielectric antenna rod.

38. The antenna of claim 37, wherein the second dielectric antenna rod is essentially made of a thermoplastic resin and the dielectric powder is barium tetratitanate or nickel-aluminum titanate.

39. The antenna of claim 32, wherein:

the first frequency transmission source is axially coupled to the first dielectric antenna rod; and the second frequency transmission source is coupled to the second dielectric antenna by a transmission line axially offset from the second dielectric antenna rod.

40. An antenna comprising:

a first dielectric antenna rod having a first dielectric constant, the first dielectric antenna rod being coupled to a first frequency transmission source for propagating first frequency band radiation from the first dielectric antenna rod into a medium having a medium dielectric constant;

a second dielectric antenna rod having a second dielectric constant, the second dielectric antenna rod being coupled to a second frequency transmission source for propagating second frequency band radiation from the second dielectric antenna rod into the medium, the first dielectric antenna rod being coaxially mounted within the second dielectric antenna rod; and a third dielectric antenna rod having a third dielectric constant, the third dielectric antenna rod being coupled to a third frequency transmission source for propagating third frequency band radiation from the third dielectric antenna rod into the medium, the second dielectric antenna rod being coaxially mounted within the third dielectric antenna rod;

wherein the first dielectric constant is greater than the second dielectric constant the second dielectric constant is greater than the third dielectric constant, and the third dielectric constant is greater than the medium dielectric constant, and wherein the difference between the first dielectric constant and the third dielectric constant is greater than about 10.

41. The antenna of claim 40, wherein the first dielectric constant is within a range of about 20 to about 30.

42. The antenna of claim 41, wherein the first dielectric antenna rod is made of barium tetra-titanate and the first dielectric constant is about 30.

43. The antenna of claim 40, wherein the second dielectric constant is within a range of about 10 to about 20.

44. The antenna of claim 43, wherein the second dielectric constant is about 12.

45. The antenna of claim 43, wherein the second dielectric antenna rod is made of silicon and has a second dielectric constant of about 11.8.

46. The antenna of claim 43, wherein the second dielectric antenna rod is made of gallium arsenide and has a second dielectric constant of about 13.2.

47. The method of structuring an antenna of claim 40, wherein the third dielectric constant is within a range of about 1.5 to about 10.

48. The method of structuring an antenna of claim 47, wherein the third dielectric antenna rod is made of Teflon™ material and the third dielectric constant is about 2.08.

49. The antenna of claim 40, wherein each of the first dielectric antenna rod, the second dielectric antenna rod and the third dielectric antenna rod has an operating beamwidth ratio of at least 2:1, and thus the antenna has an operating beamwidth ratio of at least 8:1.

50. An antenna for propagating a number N of electromagnetic waves into a medium, each electromagnetic wave having a frequency band associated therewith, the antenna comprising:

N dielectric antenna rods, each having a dielectric constant associated therewith, the N dielectric antenna rods including a core dielectric antenna rod, a number N−2 of intermediate antenna rods and an outer dielectric antenna rod; and N electromagnetic energy transmission sources, each transmission source generating and propagating one of the N electromagnetic waves from one of the dielectric antenna rods into the medium, the medium having a medium dielectric constant;

wherein the core dielectric antenna rod is coaxially mounted within one of the N−2 intermediate antenna rods, each of the N−3 remaining intermediate antenna rods is coaxially mounted within another one of the remaining intermediate antenna rods, except for one of the remaining intermediate antenna rods which is coaxially mounted within the outer antenna rod; and wherein, for a given dielectric antenna rod included in the antenna, the dielectric constant of the given dielectric antenna rod is greater than the dielectric constant of the dielectric antenna rod within which the given dielectric antenna rod is coaxially mounted, and the outer dielectric antenna rod has a dielectric constant greater than the medium dielectric constant.

* * * * *